US005129254A

United States Patent [19]

Keizer et al.

[11] Patent Number: 5,129,254

[45] Date of Patent: Jul. 14, 1992

[54] ROLLINGLY TRANSPORTABLE PRESS DIE APPARATUS

[75] Inventors: Harold F. Keizer, Fort Smith; David E. Young, Greenwood, both of Ark.

[73] Assignee: Rheem Manufacturing Company, New York, N.Y.

[21] Appl. No.: 685,855

[22] Filed: Apr. 16, 1991

[51] Int. Cl.[5] ..... B21J 13/00; B30B 15/06

[52] U.S. Cl. ..... 72/448; 100/229 R; 100/918

[58] Field of Search ..... 29/568; 83/640; 72/446, 72/444, 448; 425/186; 100/918, 224, 229 R, 53

[56] References Cited

U.S. PATENT DOCUMENTS

| | | | |
|---|---|---|---|
| 2,996,025 | 8/1961 | Georgeff | 113/49 |
| 3,229,791 | 1/1966 | Soman | 189/36 |
| 3,306,185 | 2/1967 | Soman | 100/229 |
| 3,368,479 | 2/1968 | Gregorovich | 100/229 |
| 3,422,660 | 1/1969 | Countess et al. | 72/448 |
| 3,422,662 | 1/1969 | Geuss | 72/448 |
| 3,427,855 | 2/1969 | Michelson | 100/224 |
| 3,456,481 | 7/1969 | Zeitlin | 72/446 |
| 3,559,522 | 2/1971 | Valente | 72/446 |
| 3,738,284 | 6/1973 | Atsuta | 100/918 X |
| 3,986,448 | 10/1976 | Seyfried et al. | 100/229 R |
| 4,301,673 | 11/1981 | Yonezawa | 72/448 |
| 4,528,903 | 7/1985 | Lerch | 100/229 R |
| 4,630,536 | 12/1986 | Shah | 100/229 R |
| 5,040,965 | 8/1991 | Baird | 100/918 X |

FOREIGN PATENT DOCUMENTS

| | | | |
|---|---|---|---|
| 159300 | 9/1984 | Japan | 100/918 |

*Primary Examiner*—William Briggs
*Attorney, Agent, or Firm*—Konneker & Bush

[57] ABSTRACT

A die structure for use in conjunction with a metal working press is provided without the usual large bottom plate member secured to the undersides of the spaced apart parallel members projecting downwardly from the underside of the shoe portion of the die. To permit the plateless die structure to be rollingly transported from place to place along a horizontal support surface, a plurality of specially designed lifter devices are secured to the die parallels and rotatably carry a plurality of roller members. The lifter devices are pneumatically operable and, when actuated, drive the roller members downwardly beyond the common plane in which the bottom sides of the parallels lie to thereby elevate the die structure above a horizontal support surface and rollingly support the die structure thereon. Upon deactivation thereof, the lifter devices permit the undersides of the die parallels to settle back down onto the support surface, thereby stationarily positioning the plateless die structure thereon.

17 Claims, 3 Drawing Sheets

ROLLINGLY TRANSPORTABLE PRESS DIE APPARATUS

BACKGROUND OF THE INVENTION

The present invention relates generally to die structures used in conjunction with metal working presses, and more particularly relates to methods and apparatus for transporting a die structure to and from a metal working press.

In conventional metal stamping operations, selected portions of a sheet of metal are punched out and removed utilizing a punch die structure removably interconnected to the opposed bed and vertically movable ram portions of a metal working press. The typical prior art punch die includes an upper die section positioned above a die shoe and connected to the shoe, for vertical movement relative thereto, by leader pin members. Projecting downwardly from the underside of the die shoe are two or more spaced apart, parallel support base members, usually referred to in the press art simply as "parallels". With the punch die operatively connected to the press, the metal-forming operation is carried out by positioning the metal sheet atop the die shoe and then downwardly moving the press ram to drive the upper die section into engagement with the metal sheet.

Since a conventional punch die typically weighs between 1,000 and 10,000 pounds or more, it is understandably difficult to move from its storage location to the press and back again after its use. To facilitate the transport of the die structure it has been conventional practice to attach a large metal base plate to the underside of the die parallels. During storage of the overall die structure, the base plate is supported atop the upper side surface of a storage platform into which liftable roller structures are recessed To move the die to its associated press, a specially designed die cart is used, the die cart having similarly recessed, liftable roller structures on its top side surface.

When the die is to be used, the cart is rolled up to the die storage platform, and the recessed roller structures of both the platform and the cart are elevated so that the die can be rolled along the raised platform surface rollers onto the raised rollers of the cart. The cart rollers are then lowered so that the base plate of the die rests directly on the flat top surface of the cart. After this is done, the cart is rolled to the punch press adjacent the press bed which is conventionally provided with liftable roller structures recessed into its top surface.

To transfer the die onto the press bed, the cart and press bed rollers are raised, and the die is rolled off the cart and onto the elevated bed rollers which are then lowered so that the bottom die support plate rests upon the flat upper surface of the press bed. Finally, the upper and lower die sections are respectively anchored to the press ram and the press bed to ready the press for operation.

As can readily be imagined, this previous necessity of providing recessed, liftably roller systems in die storage platforms, die carts and press beds to facilitate die changeout undesirably adds considerable expense and complexity to the overall punch press operation and requires that all three of these structures be of a customized construction. Additionally, the requirement for the large base plate secured to the undersides of the die parallels adds considerable weight and expense to each individual die structure and can undesirably add to the time and expense associated with routine maintenance thereof.

Various proposals have been made in the prior art to eliminate the necessity for providing recessed roller structures in the die storage platforms, the die transport cart, and the press bed by utilizing die-supporting structures, referred to as bolsters or carriages, which basically comprise a platform having wheels or rollers operatively secured to its underside. The bottom plate of a die structure is suitably anchored to the top of the bolster or carriage platform, and the platform wheels are positioned in tracks which lead to and from the press bed. To load a particular bed onto its associated press, the bolster is simply wheeled along the tracks until the bolster-supported die is operatively positioned on the press bed. The die and its bolster are then suitably clamped in place on the press bed.

A variety of structures are provided for lowering the underside of the bolster platform onto the top side of the press bed. For example, portions of the track sections extending across the press bed may be selectively lowered as representatively shown in U.S. Pat. No. 3,422,660 to Countess, Jr. et al and U.S. Pat. No. 3,986,448 to Seyfried et al. Alternatively, the bolster wheels may be spring-biased downwardly from the bolster platform, and the bolster platform subsequently clamped downwardly to overcome the wheel spring force, as illustrated in U.S Pat. No. 3,456,481 to Zeitlin.

U.S. Pat. No. 4,301,673 to Yonezawa discloses downwardly recessed wheels in the top of a bolster platform which may be raised to facilitate the rolling onto and off of the bolster platform of the die structure which it supports. Other disclosures of wheeled die bolster structures are present in U.S. Pat. No. 2,996,025 to Georgeff, and U.S. Pat. Nos. 3,229,791 and 3,306,185 to Soman.

A number of prior art bolsters, having platforms to which the bottom die plate is fixedly secured, are provided with vertically movable wheel structures as alternatives to collapsible track sections and the like to permit the bolster platform to be lowered onto and raised upwardly from the press bed top surface. For example, U.S. Pat. No. 3,422,662 to Geuss discloses a wheeled, die-supporting bolster secured to the underside of a die set. Lowerable sets of wheels are provided in side edge grooves of the bolster platform and are lowerable by fluid cylinders, via pivotable brackets, to elevate the bottom side of the bolster platform. Separate lifting jack mechanisms are provided in the press bed to lift the bolster platform before its wheels are lowered. U.S. Pat. No. 3,368,479 to Gregorovich illustrates liftably bolster wheels which are actuated by a motor and gear system. U.S. Pat. No. 4,528,903 to Lerch discloses a die-supporting bolster/carriage provided with wheels that are pneumatically liftable and lowerable relative to the bolster platform via the operation of pistons received in cylinders formed in the bolster platform.

While the use of these and other wheeled bolster devices to facilitate die transport arguably represents improvements over recessed wheel or roller structures provided in die storage platforms, die carts and press beds, they still present various disadvantages in the overall transport of die structures to and from their associated presses. For example, all of the above-described wheeled bolster devices require the presence on the die structure which they support of the conventional large bottom plate. Additionally, the wheeled bolster devices referred to above add considerable weight, height, and expense to the die structures to which they are secured. Further, the wheel lifting structures provided on these conventional bolster and carriage devices are of a rather complex construction.

It can readily be seen from the foregoing that a need exists for improved apparatus, operable to rollingly transport a punch die to and from its associated press, which eliminates or at least substantially reduces the above-mentioned problems, limitations, and disadvantages associated with conventional rolling die transport apparatus of the general type described. It is accordingly an object of the present invention to provide such improved apparatus.

SUMMARY OF THE INVENTION

In carrying out principles of the present invention, in accordance with a preferred embodiment thereof, an improved, rollingly transportable die structure is provided for use in conjunction with a metal working press having a bed portion disposed beneath a vertically movable ram portion. The die structure has a lower portion securable to the press bed and defined by a generally rectangular die shoe having a bottom side from which a spaced plurality of parallel support members (referred to in the press art simply as "parallels") downwardly project, the parallels having bottom side surfaces lying generally in a common plane. An upper die section, securable to the press ram, is secured above the die shoe, for vertical movement relative thereto, by a plurality of conventional leader pin members.

According to a feature of the present invention, the die structure is not provided with the conventional large bottom plate normally anchored to the undersides of the parallels in punch press dies of this general type and utilized to secure the die atop a wheeled bolster, or to provide a base for the die to support it atop liftable rollers recessed in various horizontal support surfaces along which the die is to be moved. To provide for the improved rolling transport of the die structure along a particular horizontal support surface, a plurality of specially designed lifter means are secured to the lower die portion above the common plane of the bottom sides of the die parallels.

The lifter means are vertically movable relative to the lower die portion between first and second positions. In their first position the lifter means permit the bottom side surfaces of the die parallel members to rest upon a horizontal support surface, thereby stationarily supporting the die structure thereon. When moved from their first position to their second position, the lifter means are operative to rollingly engage the horizontal support surface, while elevating the bottom side surfaces of the die parallels relative thereto, to permit the die structure to be rolled along the support surface until the lifter means are moved back to their aforementioned first position. In a preferred embodiment thereof, the lifter means are pressurizable (using, for example, compressed air from a source thereof) to drive them to their second position and are operative, when depressurized, to permit the weight of the die structure to return them to their first position.

Each of the plurality of lifter means preferably comprises an upper member anchored to the lower die portion, and a lower member secured to the underside of the upper member for limited vertical movement relative thereto. The lower member has a plurality of rollers rotatably secured thereto and having bottom side surfaces spaced downwardly apart from the underside of the bottom member.

Internal passage means are formed in the upper members and communicate with the upper ends of vertical cylinder bores formed therein and opening outwardly through the bottom sides of the upper members. Pistons are slidably received in the cylinder bores for vertical movement therein, and the internal passage means are connected to an air supply manifold system secured to the lower die portion and adapted to receive, via an appropriate quick disconnect fitting, compressed air from a source thereof.

When the top ends of the cylinder bores are pressurized, their associated pistons are driven downwardly, engage the lower members, and drive the lower members downwardly to lower limit positions thereof to accordingly drive the lifter means to the aforementioned second position thereof. When the cylinder bores are depressurized, the weight of the die structure drives the lower members upwardly to an upper position thereof, thereby returning the lifter means to the aforementioned first position thereof.

DETAILED DESCRIPTION

Figure 1:
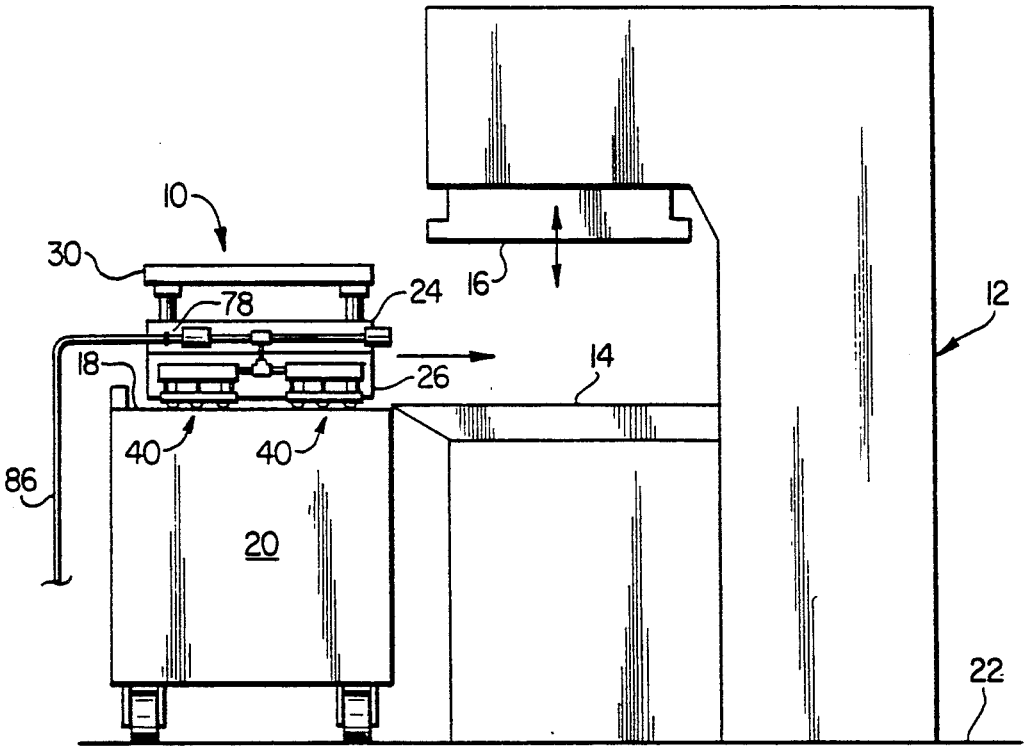
FIG. 1 is a simplified side elevational view of a plateless die structure of the present invention being rolled onto the bed portion of a metal working press.

Illustrated in FIGS. and 2 is an improved die structure 10 which incorporates principles of the present invention and is usable in conjunction with a conventional metal-working punch press 12 having an elevated, horizontal bed surface 14 disposed beneath a vertically movable ram portion 16 of the press. The die structure 10 is representatively illustrated in FIG. 1 as being positioned atop the flat upper end surface 18 of a conventional wheeled die cart 20 which may be rolled along the illustrated floor 22 toward and away from the press 12. In a unique manner subsequently described, the die structure 10 may be rolled from the cart support surface 18 onto the press bed 14, and back onto the cart surface 18, without the conventional use of liftable roller structures recessed into the surfaces 14, 18 and without the use of wheeled bolster or carriage devices anchored to the underside of the die structure.

Figure 2:
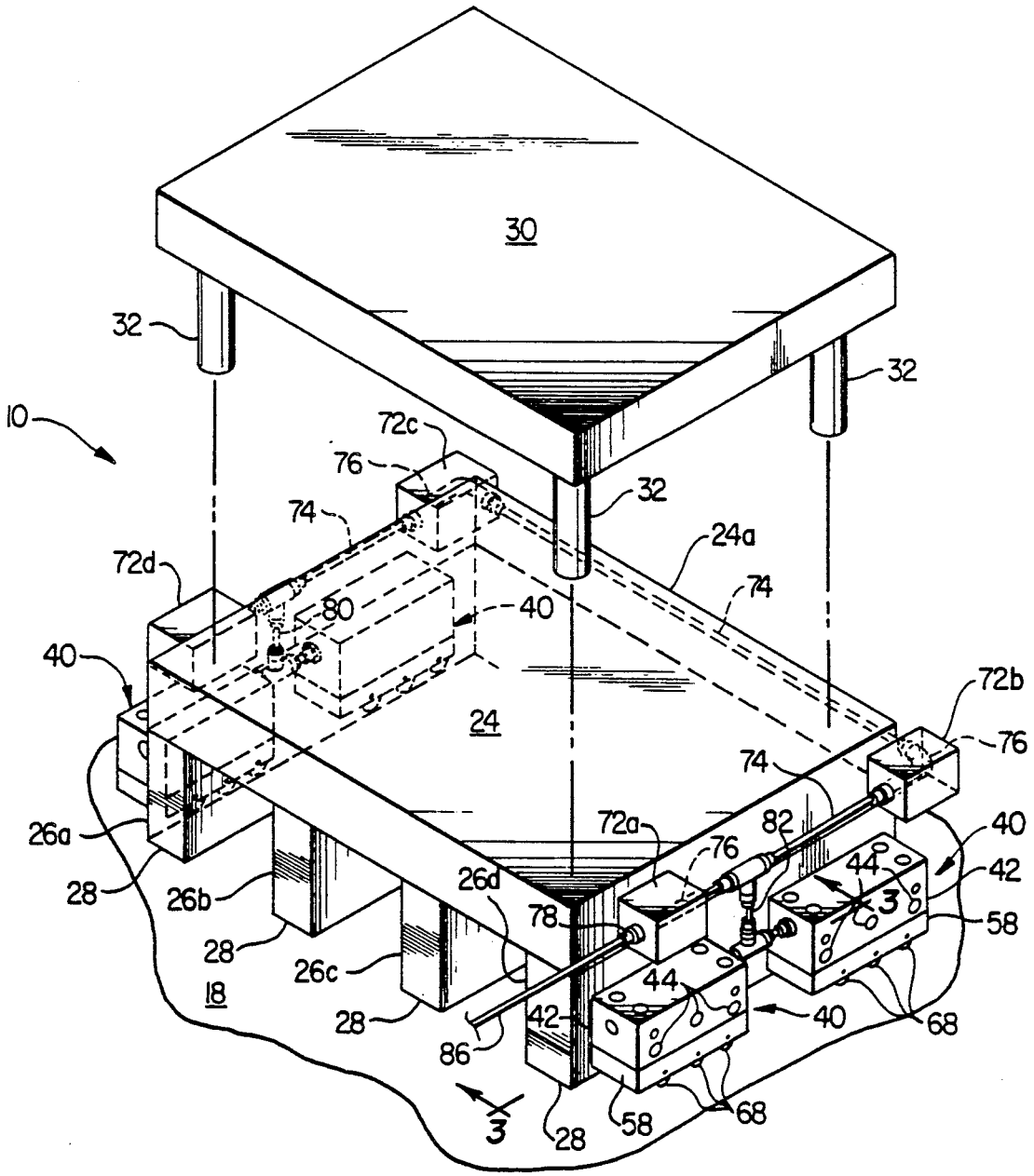
FIG. 2 is an enlarged scale partially exploded perspective view of the plateless die structure.
Figure 5:
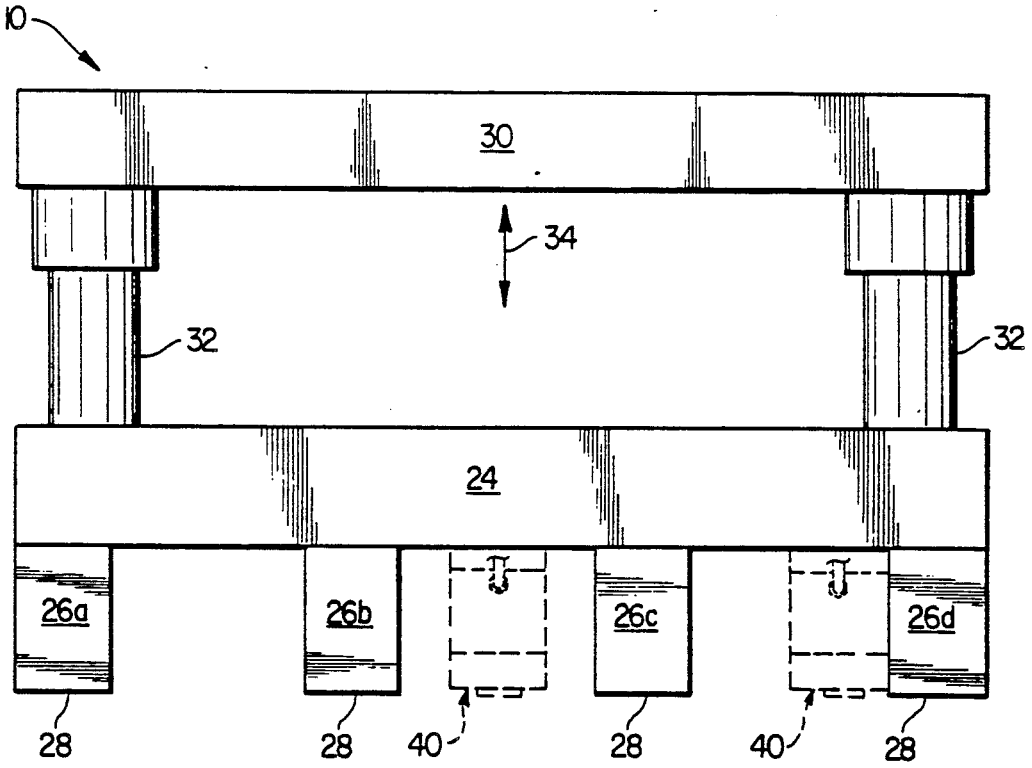
FIG. 5 is a side elevational view of the die structure illustrating, in phantom, alternate placements thereon of its lifter assemblies.

As depicted in FIGS. 1, 2, and 5, the die structure 10 has a lower portion which includes a conventionally configured rectangular die shoe 24 from whose underside a plurality of spaced apart, parallel support members $26_a$–$26_d$ downwardly project. The members $26_a$–$26_d$ are commonly referred to in the press art simply as "parallels" and have bottom side surfaces 28 lying in a common plane. In a conventional manner, the die structure 10 is provided with a rectangular upper die section 30 which is positioned above and parallel to the die shoe 24. The upper die section 30 is connected to the die shoe 24 by means of four leader pin members 32 which, as indicated by the double-ended arrow 34 in FIG. 5, permit the upper die section to be moved vertically toward and away from the die shoe 24.

When the die structure 10 is operatively positioned on the press bed 14, the lower die portion is suitably secured to the press bed, and the upper die section 30 is suitably anchored to the press ram 16 for vertical movement thereby toward and away from the die shoe. In the usual manner, with the upper die section 30 in an elevated position, a sheet of metal to be formed is placed on the upper side of the die shoe 24, and the ram 16 is moved downwardly to cause the upper die section 30 to engage the metal sheet and cooperate with the die shoe 24 to appropriately deform the metal sheet or punch out selected portions thereof.

It should be noted at the outset that, unlike punch press dies of conventional construction, the die structure 10 is not provided with the usual large rectangular bottom plate which is customarily anchored to the undersides 28 of the parallels $26_a$–$26_d$. Accordingly, the die structure 10 will be hereinafter referred to as a "plateless" die structure The unique absence of the aforementioned bottom plate permits the bottom sides 28 of the die parallels to be rested directly upon a support surface, such as the top cart surface 18 shown in FIG. 2, to stationarily position the die structure on such support surface.

Figure 3:
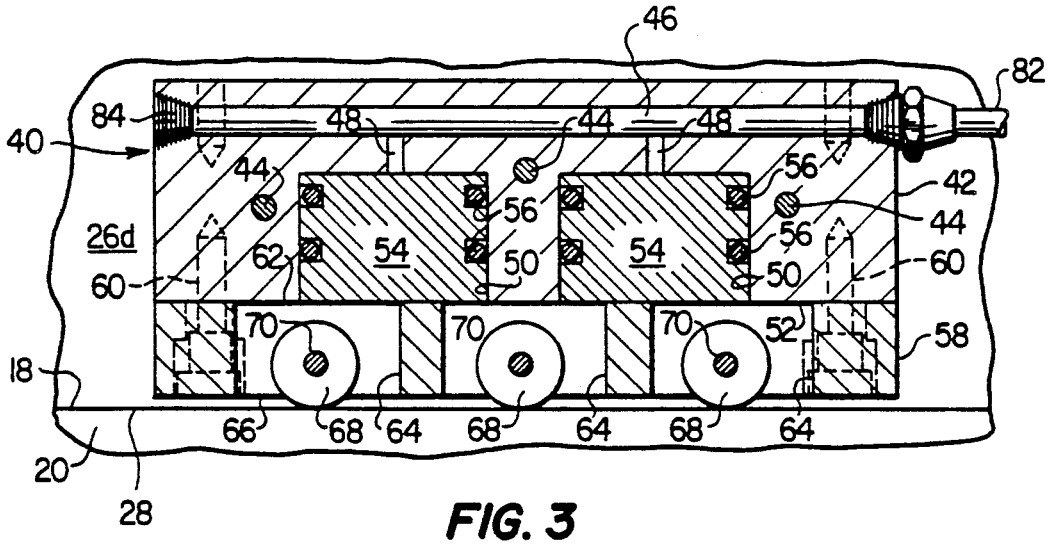
FIG. 3 is an enlarged scale cross-sectional view through a pneumatically operable lifter assembly portion of the die structure taken along line 3—3 of FIG. 2, with the lifter assembly in its unactuated, die-lowering position.

Referring now to FIGS. 2 and 3, the plateless die structure 10 is rollingly transportable along a particular horizontal support surface by means of a very compact lifting system which is secured to the lower die portion, above the common plane of the bottom parallel sides 28, and forms an important aspect of the present invention. The lifting system representatively includes four pneumatically operable lifter assemblies 40, two of which are secured to the outer side surface of the die parallel $26_a$, and two of which are secured to the outer side surface of the die parallel $26_d$.

As cross-sectionally indicated in FIG. 3, each of the lifter assemblies 40 includes an upper rectangular metal block 42 which is anchored to its associated die parallel 26 by fastening members such as bolts 44. Extending horizontally through an upper portion of the block 42, between its opposite left and right ends, is a circularly cross-sectioned air flow passage 46 having vertical branch passages 48 that communicate with top ends of a pair of circular cylinder bores 50 which open outwardly at their lower ends through the bottom side surface 52 of the upper block 42. A pair of pistons 54 are slidably disposed within the bores 50, for vertical movement therein, and are provided with appropriate annular peripheral sliding seal elements 56.

Figure 4:
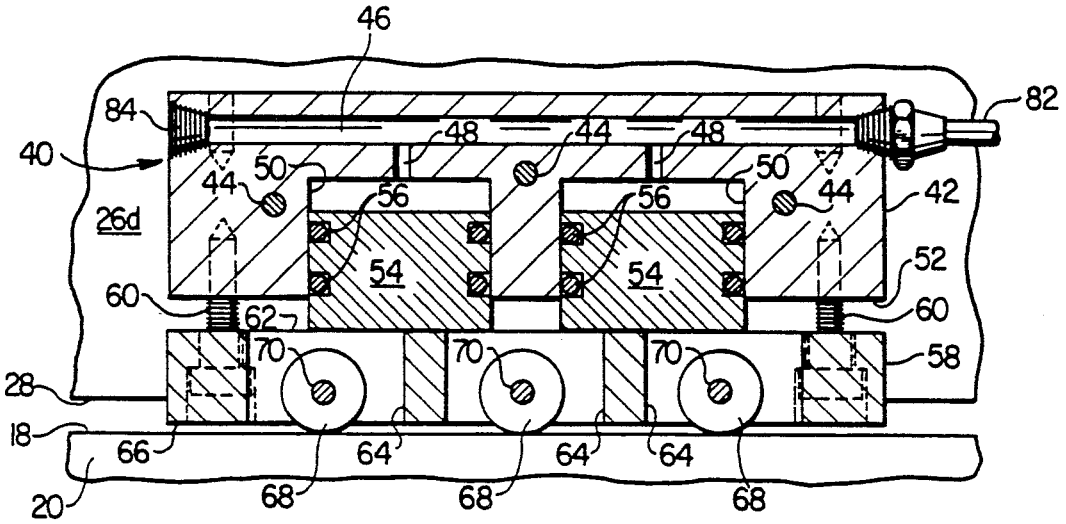
FIG. 4 is a cross-sectional view similar to that in FIG. 3, but with the lifter assembly in its actuated, die-lifting position.

Each of the lifter assemblies 40 also includes a rectangular lower metal block member 58 disposed beneath the upper block member 42. The lower block member 58 is secured to the underside of block 42 by means of conventional shoulder bolts 60 which permit vertical movement of the lower block 58 relative to the upper block 52 between an unactuated, upper limit position (FIG. 3) in which the upper side 62 of the lower block 58 abuts the bottom side 52 of the upper block 42, and an actuated, lower limit position (FIG. 4) in which the lower block 58 is positioned downwardly apart from the upper block 42. Three horizontally spaced apart slots 64 extend vertically through the lower block 58 from its upper side 62 to its lower side 66. Three cylindrical roller members 68 are journaled within the slots 64 on shafts 70 and, as indicated in FIGS. 3 and 4, have bottom side portions which project downwardly beyond the bottom side 66 of the lower block 58.

Referring now to FIG. 2, the horizontal interior passages 46 in the four upper blocks 42 are intercommunicated by an air supply manifold system which includes two rectangular metal manifold block members $72_a$, $72_b$ secured to the right end of the die shoe 24, and two rectangular metal manifold block members $72_c$, $72_d$ secured to the left end of the die shoe 24. The manifold blocks are interconnected as shown by three horizontal lengths of air supply tubing 74, the interiors of which are communicated by means of internal passages 76 formed in the blocks $72_a$, $72_b$, and $72_c$. As illustrated in FIG. 2, the four manifold blocks project outwardly beyond the tubing lengths 74 which interconnect them, with the blocks $72_b$ and $72_c$ projecting rightwardly beyond the rear side $24_a$ of the die shoe 24. Accordingly, the four manifold blocks provide a degree of protection for the tubing lengths 74 against impact during handling of the die structure 10 A quick disconnect air fitting 78 is secured to the left end of the manifold block $72_a$ and communicates with its internal passage 76

The tubing length 74 interconnected between the manifold blocks $72_c$, $72_d$ is communicated with the internal passages 46 of the left pair of lifter assemblies 40 by branch tubing 80, while the tubing length 74 interconnected between manifold blocks $72_a$, $72_b$ is communicated with the interior passages 46 of the right pair of lifter assemblies 40 by branch tubing 82. Each of the tubing branch sections 80, 82 is connected to one end of its two associated upper block passages 46, with the opposite end of each of the four internal block passages 46 being closed with a suitable plug member 84 as indicated in FIGS. 3 and 4.

Via the manifolded air supply system just described, the upper ends of all of the upper block cylinder bores 50 may be simultaneously pressurized simply by removably securing a pressurized air supply hose 86 (FIG 1) to the quick disconnect fitting 78. In the absence of such pressurization, the weight of the die structure 10 drives the lower block members 58 upwardly to their unactuated, upper limit positions shown in FIG. 3, at which point the lower sides 28 of the die parallels $26_a$–$26_d$ settle down onto the support surface 18, thereby stationarily positioning the die structure 10 on the support surface 18. The upper and lower block portions 42, 58 of each lifter assembly 40 are relatively dimensioned and positioned on their associated die parallel such that when the lower block members 58 are moved upwardly to the unactuated positions, the lower sides of the roller members 68 are flush with the common plane of the bottom die parallel sides 28 as shown in FIG. 3, thereby effectively rendering the roller members 68 inoperative.

However, when the upper ends of the cylinder bores 50 are simultaneously pressurized, the pistons 54 (FIG. 4) are driven downwardly through the open lower ends of the bores 50 and engage their associated lower block members 58 and drive them downwardly to their actuated, lower limit positions shown in FIG. 4. This causes the roller members 68 to be driven downwardly past the lower sides of the die parallels, forcibly engage the support surface 18, and lift the entire die structure 10 upwardly from the support surface 18.

The lowered roller members 68, which have now lifted the die structure 10, also now support the elevated die structure for rolling movement along the support surface 18. When it is desired to again stationarily position the die structure 10 on its associated horizontal support surface, the air supply hose 86 is simply removed from the quick disconnect fitting 78, thereby allowing the cylinder bores 50 to depressurize and permitting the bottom sides 28 of the die parallels to settle back onto the support surface as illustrated in FIG. 3.

The use of the small lifter assemblies 40 on the plateless die structure 10 permits it to be very easily and rapidly moved from its storage platform to the press bed 14 and then back to its storage platform again when required. Specifically, with the lifter assemblies 40 in their unpressurized states, and the bottom sides 28 of the die parallels resting upon the die storage platform, the lifter assemblies are simply pressurized to lower the roller member 68 as described above. The die structure is then rolled off its support platform and onto the top surface 18 of the conventional die cart 20. The lifter assemblies are then depressurized to allow the die structure to settle down onto the cart surface 18. The cart 20 is then rolled along the floor 22 into close adjacency with the press 12 as shown in FIG. The air supply hose 86 is then re-connected to the quick disconnect fitting 78 to again elevate the die structure 10 which is then simply rolled onto the press bed 14. The air supply hose 86 is then removed from the quick disconnect fitting 78 to permit the die structure 10 to settle down onto the press bed 14. Finally, the upper die section 30 is appropriately secured to the ram 16, and the lower die portion is appropriately secured to the press bed 14 to ready the now operatively positioned die structure 10 for its metal forming task.

To return the die structure 10 to its storage location, the die structure is disconnected from the press bed 14 and the ram 16, pneumatically raised as previously described, rolled onto the top side 18 of the die cart 20 and then re-lowered. The lowered die structure 10 is then rolled to its storage location on the cart 20, pneumatically raised, rolled off the cart 20 onto the die storage platform, and then re-lowered.

It can readily be seen from the foregoing that the use of the lifter assemblies 40 totally eliminates the previous necessity of securing a large bottom plate to the undersides of the die parallels 26, eliminates the previous necessity of securing a wheeled bolster or carriage to the underside of the bottom plate, and eliminates the previous necessity of providing the die storage platform, the cart 20, and the press bed 14 with liftable roller structures recessed into their upper side surfaces. This significantly simplifies and reduces the overall cost involved in rollingly transporting the die structure from place to place. The elimination of the customary die bottom plate, and the use of the lifter assemblies 40, also significantly reduces both the overall weight of the die structure and its maximum height. The elimination of the bottom die plate also facilitates the normal maintenance of the die structure.

A number of modifications could be made to the illustrated die structure lifting system. For example, the pistons 54 could be incorporated in the lower blocks 58, and bear upwardly against the upper block 42, instead of being disposed within the upper block 42 and bearing downwardly against the lower block 58. Additionally, pressurized fluids other than air could be utilized to provide the die structure lifting force if desired.

Another modification that could be made to the illustrated die structure lifting system would be to replace the illustrated four lifting assemblies with two lifting assemblies (one each on the die parallels $26_a$ and $26_d$) in which the upper and lower blocks 42 and 58 were longer in the left-to-right direction as viewed in FIG. 2. While it is particularly convenient, from an access standpoint, to secure the lifter assemblies 40 to the outer side surfaces of the die parallels $26_a$ and $26_d$ as shown in FIG. 2, it will be appreciated that the lifter assemblies could be secured to alternate locations on the lower die portion. For example, as shown in phantom in FIG. 5, the lifter assemblies 40 could be secured to the inner side surfaces of the die parallels $26_a$, $26_d$ (or to side surfaces of the parallels $26_b$, $26_c$), or secured to the underside of the die shoe 24 between adjacent pairs of die parallels.

The foregoing detailed description is to be clearly understood as being given by way of illustration and example only, the spirit and scope of the present invention being limited solely by the appended claims.

What is claimed is:

1. A plateless die structure for use in conjunction with a metal working press, comprising:

an upper die portion;

a lower die portion including a die shoe positioned beneath said upper die portion, and a spaced plurality of parallel members extending downwardly from said die shoe and having bottom side surfaces;

means for interconnecting said upper die portion and said die shoe in a manner permitting relative vertical movement therebetween; and lifter means secured to said lower die portion above said bottom side surfaces of said parallel members for selective movement relative to said lower die portion between first and second positions, said lifter means in said first position permitting said bottom side surfaces of said parallel members to rest upon a horizontal support surface and stationarily support said plateless die structure thereon, said lifter means, when moved from said first position to said second position, being operative to rollingly engage the horizontal support surface, while elevating said bottom side surfaces of said parallel members relative thereto, to permit said plateless die structure to be rolled along the support surface until said lifter means are moved back to said first position thereof, said lifter means including a spaced apart plurality of support members having roller members rotatably secured to and projecting downwardly from bottom portions thereof, means for securing said support members to said lower die portion for vertical translational movement relative thereto, and piston means, movable along vertical axes, for utilizing pressurized fluid from a source thereof to downwardly drive said support members relative to said lower die portion.

2. The plateless die structure of claim 1 wherein:

said lifter means are secured to vertical side surfaces of said parallel members.

3. The plateless die structure of claim 1 wherein:

said lifter means are secured to the underside of said die shoe.

4. A plateless die structure for use in conjunction with a metal working press, comprising:

an upper die portion;

a lower die portion including a die shoe positioned beneath said upper die portion, and a spaced plurality of parallel members extending downwardly from said die shoe and having bottom side surfaces;

means for interconnecting said upper die portion and said die shoe in a manner permitting relative vertical movement therebetween; and lifter means secured to said lower die portion above said bottom side surfaces of said parallel members and operative to selectively permit said bottom side surfaces to stationarily rest upon a horizontal support surface or to rollingly support said plateless die structure on and in an elevated relationship with the support surface, said lifter means including:

a spaced plurality of first members fixedly anchored to said lower die portion above said bottom side surfaces of said parallel members, a spaced plurality of second members each disposed beneath an associated one of said plurality of first members and having a lower side, support roller members operatively secured to said lower sides of said plurality of second members, means for connecting said plurality of second members to said plurality of first members for vertical translational movement toward and away from their associated first members, and force exerting means, carried by one of said pluralities of first and second members for driven vertical translational movement relative thereto into engagement with the other of said pluralities of first and second members using an external power source, for separating said pluralities of first and second members with sufficient force to lift said lower die portion above and thereby rollingly support it on the horizontal support surface.

5. A plateless die structure for use in conjunction with a metal working press, comprising:

an upper die portion;

a lower die portion including a die shoe positioned beneath said upper die portion, and a spaced plurality of parallel members extending downwardly from said die shoe and having bottom side surfaces lying generally in a common plane;

means for interconnecting said upper die portion and said die shoe in a manner permitting relative vertical movement therebetween; and a plurality of lifter means secured to said lower die portion and operable to selectively permit the undersides of said parallel members to rest upon a horizontal support surface or to elevate said plateless die structure relative to the support surface and rollingly support said plateless die structure thereon, each of said lifter means including:

a first member, means for anchoring said first member to said lower die portion above said common plane, a second member disposed beneath said first member and having a lower side surface, means for connecting said second member to said first member for limited vertical movement relative thereto, a plurality of roller members rotatably carried by said second member and having side portions projecting downwardly beyond said lower side surface thereof, and pressure operable means, carried by one of said first and second members, for selectively causing said second member to be driven downwardly away from said first member in a manner moving said side portions of said roller members downwardly past said common plane, said pressure operable means including piston means carried within said one of said first and second members for vertical movement relative thereto, said piston means being pressure drivable into engagement with the other of said first and second members to downwardly drive said second member away from said first member.

6. A plateless die structure for use in conjunction with a metal working press, comprising:

an upper die portion;

a lower die portion including a die shoe positioned beneath said upper die portion, and a spaced plurality of parallel members extending downwardly from said die shoe and having bottom side surfaces lying generally in a common plane;

means for interconnecting said upper die portion and said die shoe in a manner permitting relative vertical movement therebetween; and a plurality of lifter means secured to said lower die portion and operable to selectively permit the undersides of said parallel members to rest upon a horizontal support surface or to elevate said plateless die structure relative to the support surface and rollingly support said plateless die structure thereon, each of said lifter means including:

a first member, means for anchoring said first member to said lower die portion above said common plane, a second member disposed beneath said first member and having a lower side surface, means for connecting said second member to said first member for limited vertical movement relative thereto, said means for connecting said second member to said first member including a plurality of shoulder bolts operatively interconnecting said first and second members and permitting limited vertical movement of said second member relative to said first member, a plurality of roller members rotatably carried by said second member and having side portions projecting downwardly beyond said lower side surface thereof, and pressure operable means, carried by one of said first and second members, for selectively causing said second member to be driven downwardly away from said first member in a manner moving said side portions of said roller members downwardly past said common plane.

7. The plateless die structure of claim 5 wherein:

at least one of said plurality of lifter means is secured to a vertically extending side of one of said spaced plurality of parallel members.

8. The plateless die structure of claim 5 wherein:

at least one of said plurality of lifter means is secured to the underside of said die shoe between an adjacent pair of said spaced plurality of parallel members.

9. The plateless die structure of claim 4 wherein:

said force exerting means include a plurality of fluid pressure operable piston members.

10. The plateless die structure of claim 5 wherein:

said piston means are carried within said first member for pressure driven vertical movement relative thereto into driving engagement with said second member.

11. The plateless die structure of claim 5 further comprising:

air supply manifold means, carried by said lower die portion and connected to said plurality of lifter means, for receiving pressurized fluid from a source thereof and utilizing the received fluid to operatively drive said piston means in said plurality of lifter means.

12. The plateless die structure of claim 11 wherein:

said first members have cylinder bores formed therein and internal passages communicating with said cylinder bores, said piston means are operatively received in said cylinder bores, and said air supply manifold means include a plurality of hollow manifold blocks secured to said lower die portion, supply conduit means for communicating the interiors of said manifold blocks with said internal passages, and quick disconnect fitting means for receiving pressurized fluid from a source thereof and flowing the received fluid into the interior of said supply conduit means.

13. The plateless die structure of claim 12 wherein:

said die shoe has vertically extending side surfaces, said manifold blocks are secured to said vertically extending side surfaces, and said plurality of lifter means are secured to at least two of said parallel members.

14. Die lifter apparatus for use in conjunction with a die structure having an upper die portion; a lower die portion including a die shoe positioned beneath said upper die portion, and a spaced plurality of parallel members extending downwardly from said die shoe and having bottom side surfaces lying generally in a common plane; and means for interconnecting said upper die portion and said die shoe in a manner permitting movement of said upper die portion toward and away from said die shoe, said die lifter apparatus comprising:

an upper block member;

a lower block member positioned beneath said upper block member and having a lower side surface;

a plurality of roller members rotatably carried by said lower block member and having bottom side surfaces spaced downwardly apart from said lower side surface of said lower block member;

means for connecting said lower block member to said upper block member for movement toward said upper block member to a first position, and away from said upper block member to a second position;

piston means carried within one of said upper and lower block members for movement relative thereto toward and away from the other of said upper and lower block members;

passage means, formed in said one of said upper and lower block members and communicating with said piston means, for receiving pressurized fluid from a source thereof, said piston means being operative to engage said other of said upper and lower block members, and forcibly drive said lower block member to said second position thereof, in response to pressurization of said passage means, said piston means being further operative to permit said lower block member to be relatively easily returned to said first position thereof in response to depressurization of said passage means and the presence of an upwardly directed external force on said lower block member; and means for fixedly securing said upper block member to said lower die portion in a position thereon such that when said lower block member is driven to said second position thereof said bottom side surfaces of said roller members are spaced downwardly apart from said common plane, and when said lower block member is returned to said first position thereof said bottom side surfaces of said roller members do not project downwardly beyond said common plane.

15. The die lifter apparatus of claim 14 wherein:

said means for connecting include a plurality of shoulder bolts operatively interconnected between said upper and lower block members

16. The die lifter apparatus of claim 14 wherein:

said piston means are carried within said upper block member.

17. The plateless die structure of claim 9 wherein:

said fluid pressure operable piston members are slidably carried by said plurality of first members.

* * * * *

UNITED STATES PATENT AND TRADEMARK OFFICE

CERTIFICATE OF CORRECTION

PATENT NO. : 5,129,254

DATED : July 14, 1992

INVENTOR(S) : Harold F. Keizer and David E. Young

It is certified that error appears in the above-identified patent and that said Letters Patent is hereby corrected as shown below:

Column 4, line 41, "FIGS. and 2" should be --FIGS. 1 and 2--.

Signed and Sealed this

Tenth Day of August, 1993

*Attest:*

Michael K. Kirk

MICHAEL K. KIRK

*Attesting Officer*

*Acting Commissioner of Patents and Trademarks*